US006112819A

United States Patent [19]

Henry

[11] Patent Number: 6,112,819

[45] Date of Patent: Sep. 5, 2000

[54] FOAMING WATER DISPENSER AND METHOD

[75] Inventor: Darren Henry, Redding, Calif.

[73] Assignee: Advent Marketing, Inc., Asheboro, N.C.

[21] Appl. No.: 09/354,540

[22] Filed: Jul. 15, 1999

[51] Int. Cl.[7] ..... A62C 5/02

[52] U.S. Cl. ..... 169/15; 169/14; 239/433

[58] Field of Search ..... 169/15, 14, 44, 169/52; 239/303, 308, 433

[56] References Cited

U.S. PATENT DOCUMENTS

| | | | |
|---|---|---|---|
| 5,113,945 | 5/1992 | Cable | 169/14 X |
| 5,427,181 | 6/1995 | Laskaris et al. | 169/14 |
| 5,492,655 | 2/1996 | Morton et al. | 239/433 X |
| 5,645,223 | 7/1997 | Hull et al. | 239/433 X |
| 5,881,817 | 3/1999 | Mahrt | 169/15 |

FOREIGN PATENT DOCUMENTS

| | | | |
|---|---|---|---|
| 94/23798 | 10/1994 | WIPO | 169/14 |

*Primary Examiner*—Lesley D. Morris

[57] ABSTRACT

A main tank of a foamable soap and water mixture is fluidly connected to a manifold positioned on top of the tank. A pair of air tanks are fluidly connected to the manifold as well and are also mounted on the tank. Within the manifold the foamable fluid of the tank and the gas of the air tanks is mixed in a manner such that the gas is parallel to the flow of the fluid through the manifold thereby precluding a damming effect of the fluid by the air. This foams the foamable fluid which is then passed to a conventional fire hose for dispersement therethrough.

13 Claims, 4 Drawing Sheets

FOAMING WATER DISPENSER AND METHOD

BACKGROUND OF THE INVENTION

1. Field of the Invention

This invention pertains to a portable foaming water dispenser for use in combating fires and the like.

2. Description of the Prior Art and Objectives of the Invention

Firefighters employ a number of techniques and devices to combat fires including water, dirt and soapy foam. A typical fire truck carries five hundred gallons of water. It has been found that foams are more effective than water at combating many fires, however, there has been little innovation in providing portable foam delivering devices to the firefighting community. Furthermore, hoses filled with water are heavy and cumbersome, frequently requiring a plurality of firefighters to manipulate.

One device is that sold by HFS Fire Defense Systems out of Redding Calif. under the name TRIMAX 30. This device is portable and foams a soap and water batch mixture prior to introducing the mixture into a hose for delivery by a firefighter. However, this device includes a manifold which injects the air at an angle to the flow of the water, thus creating a damming effect which in turn hinders the flow of the foaming water into the hose. Likewise, the damming effect may cause the mixture to flow backwards into the storage container thus clogging the device.

With the above concerns in mind, it is an objective of the present invention to provide a device which is portable and delivers a foamed mixture to a hose.

It is a further objective of the present invention to provide a device which foams a mixture prior to introduction into a hose so that the hose, when filled with the mixture remains relatively light.

It is still a further objective of the present invention to provide a device which injects air into a flow of water parallel to the flow of water to foam the water.

It is yet a further objective of the present invention to provide a method of foaming a batch mixture of a foaming agent, such as soap, and water which provides an efficient means of introducing a foaming mixture to a firefighting hose.

These and other objectives and advantages will become readily apparent to those skilled in the art upon reference to the following detailed description and accompanying drawing figures.

SUMMARY OF THE INVENTION

This invention comprises a main thirty gallon tank mounted on a plurality of wheels by a traditional square frame. Attached to the main tank are two air tank housings, one on either side of the oblong main tank. The tank itself, as well as its accessories, are formed except where noted from rigid steel or iron in sufficient thickness to contain highly pressurized water or the like.

A conventional small air tank, such as used in the scuba industry, is positioned in each of the housings with conventional hose connections to a manifold which is positioned atop the tank. Conventional valves allow air to be selectively introduced into the manifold as well as to selectively introduce the contents of the tank into the manifold. The preferred mixture within the main tank is a foaming agent, such as concentrated soap, and water batch mixture under pressure. When both valves are opened, the batch mixture flows into the manifold along with pressurized air from the scuba tanks. Within the manifold, the air travels in a cross bar and is released into the flow of the batch mixture parallel to the flow of the batch mixture. This mixing of air and batch mixture causes the batch mixture to foam immediately. A conventional fire hose is attached to a conventionally threaded end of the manifold. The now foamed batch mixture travels through the manifold and into the hose where it is dispersed from the distal end of the hose as is conventional. The advantage this arrangement provides over a conventional fire hose is that the hose is filled with relatively light foam rather than water. This allows fewer individuals to manipulate the hose, freeing other firefighters for other jobs. Additionally, this arrangement of introducing the air directly parallel to the flow of the batch mixture provides an advantage over the prior art foaming device in that no damming effect is created, freeing the foaming batch mixture to enter the hose quickly and efficiently. The preferred pressures of the batch mixture and the air within the scuba tanks is 165 psi each. Nitrogen gas may be used in place of air in certain circumstances.

An alternate embodiment provides for the introduction of the foaming element directly into the manifold rather than as a batch mixture within the main tank. The manifold allows for the introduction of fluids from either direction of the cross bar, so this substitution is easily effectuated.

DETAILED DESCRIPTION OF THE PREFERRED EMBODIMENT AND OPERATION OF THE INVENTION

Figure 1:
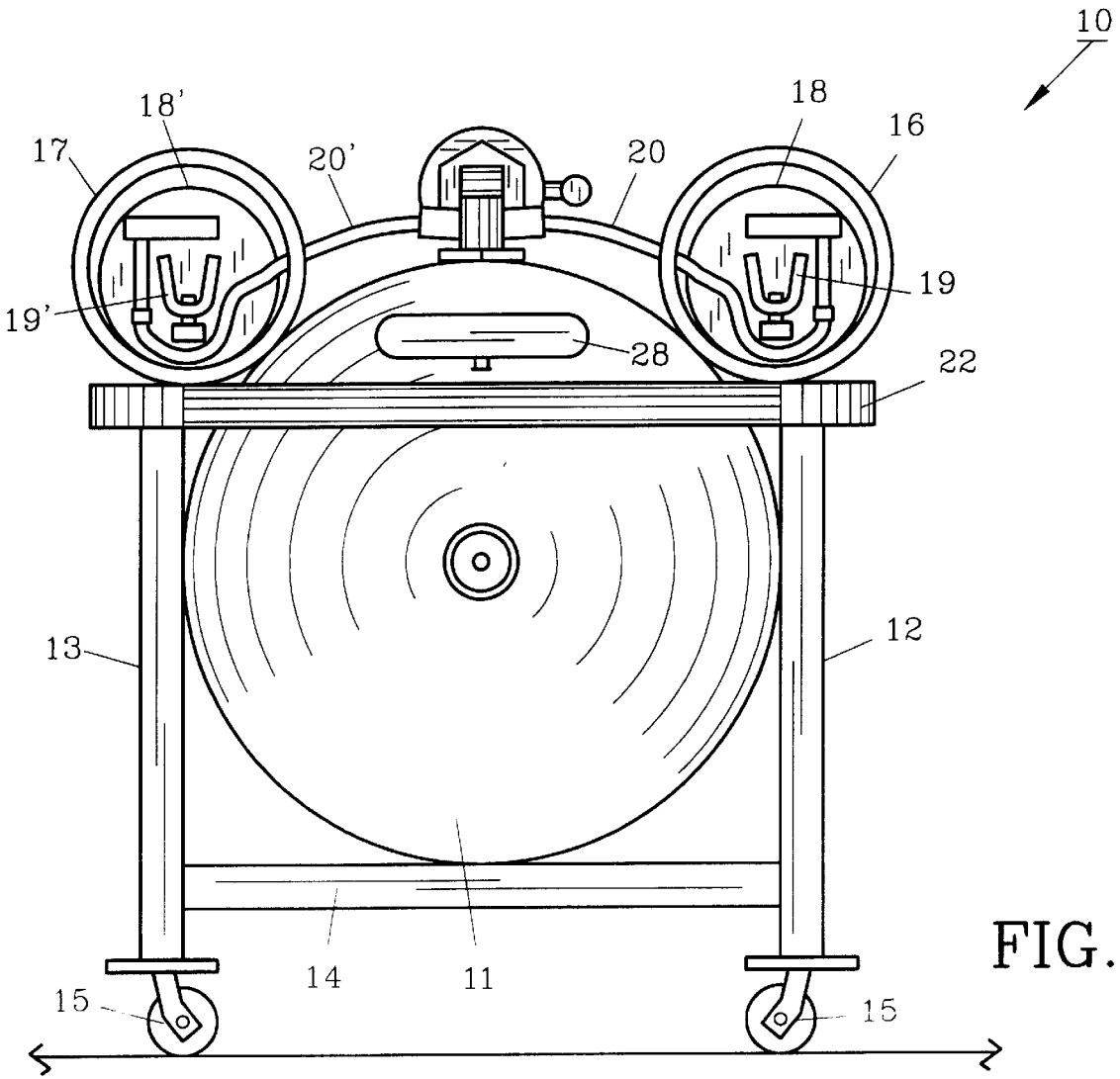
FIG. 1 shows a front view of the device of the present invention.

Turning now to the drawings, specifically FIG. 1 shows the front end of preferred water foaming dispenser 10. Water foaming dispenser comprises main tank 11 which holds approximately thirty gallons of a batch mixture of soap and water (not shown) under a pressure of one hundred sixty-five psi. In order to accommodate such pressure and capacity, tank 11 is formed from steel or other rigid, non-oxidizing metal. Tank 11 is supported by vertical members 12 and 13 which in turn are connected by cross bar 14. Vertical members 12, 13 and cross bar 14 collectively form a support frame. Wheels 15 allow dispenser 10 to be easily maneuvered. While not shown, dispenser 10 is well suited for travel in the back of a conventional pickup truck. While not shown, the wheels on the opposite end of tank 11 may be larger than wheels 15 to provide a more wheel barrow like movement capability of dispenser 10, especially when used with handle 22.

Attached to the top of tank 11 are air tank housings 16 and 17, which contain conventional compressed air tanks 18 and 18' respectively. Air tanks 18 and 18' are tanks such as are commonly used for scuba divers and contain 80 cubic feet of air at three thousand psi. As an alternative, nitrogen gas can be used in place of air. Valves 19 and 19' control the release of air from tanks 18 and 18' respectively and step the pressure down to 165 psi. Plate 21 (FIG. 2) helps provide a secure connection between tank 11 and housings 16 and 17, and can act as a base when dispenser 10 is stored in an upright position.

Figure 2:
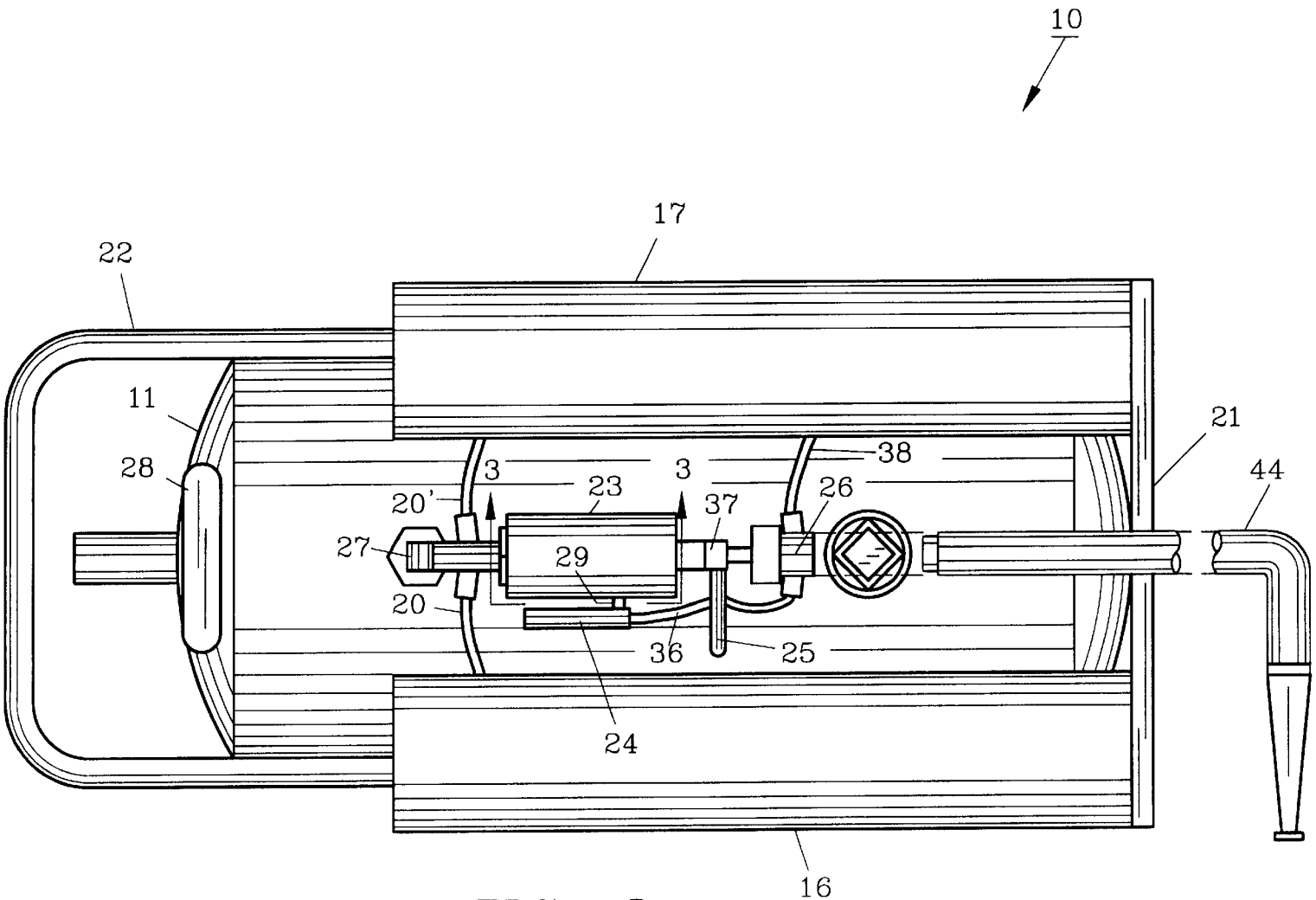
FIG. 2 illustrates a top view of the device of FIG. 1.

Hoses 20 and 20' better seen in FIG. 2 bring the pressurized air from tanks 18 and 18' to elbow joint 27. Elbow joint 27 fluidly connects tank 11 to manifold 23. Proximate elbow joint 27 is t-handle 28 which may be used to lift the handle end of tank 11. Handle 24 opens valve 29 attached to hose 36 which fluidly connects to hose 38 which may be attached to a container (not shown) of a foaming agent such as concentrated soap. This would be used in the event that a user desires not to have a pre-mixed batch of soap and water in tank 11. Handle 25 controls valve 37 which allows the foamed mixture to pass into conventional threaded fire hose attachment or coupling 26. Conventional fire hose 44 may be threaded on attachment 26 and used to dispense the foamed material. Since only foam is passed into hose 44, it remains light and easy to manage relative to conventional water filled hoses.

Figure 3:
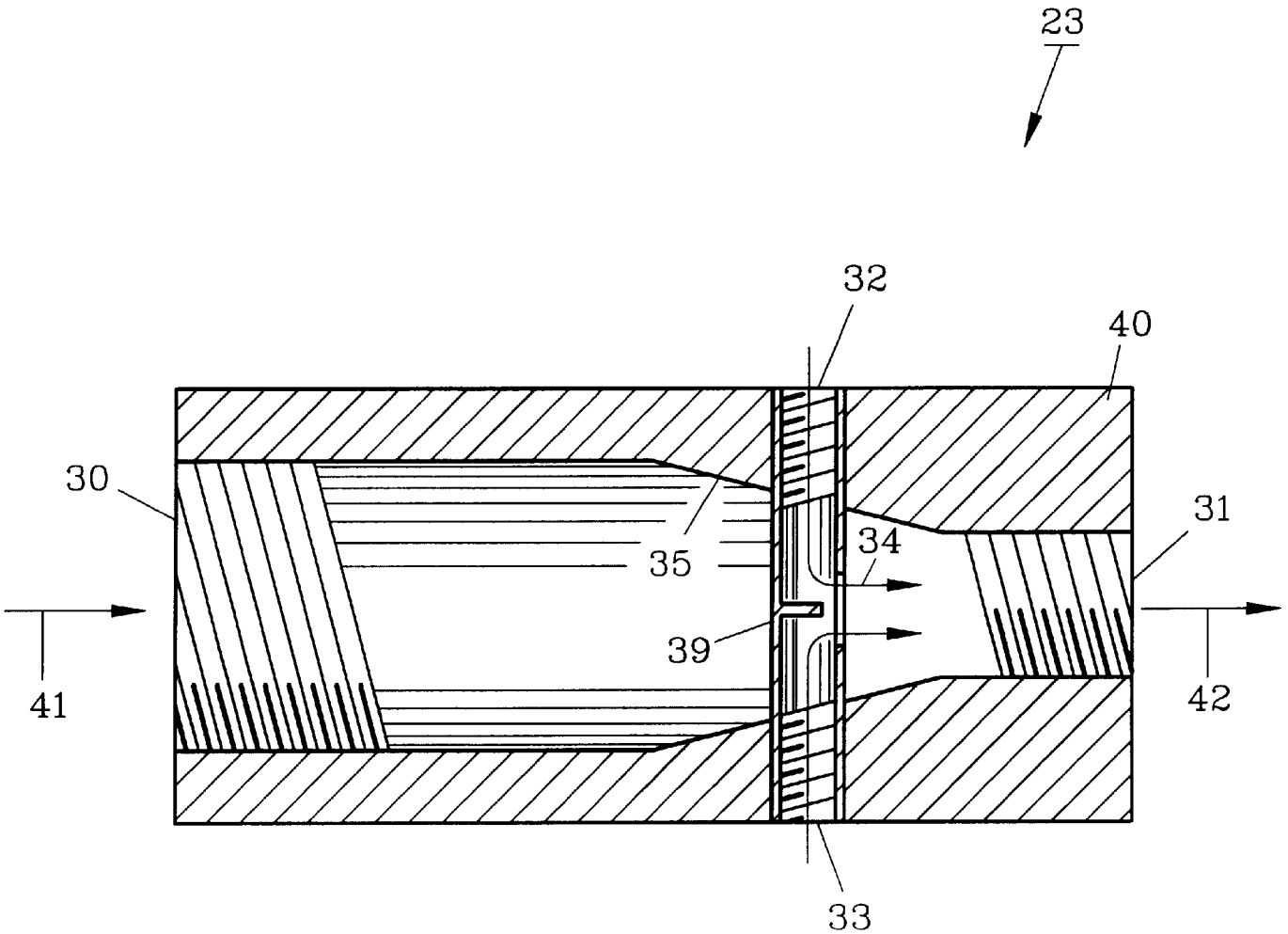
FIG. 3 demonstrates a cross-sectional view of the manifold taken along lines 3—3 of FIG. 2.

Manifold 23, best seen in FIG. 3 comprises body 40 with proximal end 30 and distal end 31. Proximal end 30 is contiguous elbow joint 27 while distal end 31 is contiguous valve 37. Smooth taper 35 reduces the friction within body 40 as fluid passes therethrough. In the preferred embodiment, the batch fluid enters body 40 at proximal end 30 as generally indicated by arrow 41 and passes over cross member 39 thus passing through manifold 23 along its longitudinal axis. Air from tanks 18 and 18' enter cross member or bar 39 by entry apertures 32 and 33 respectively. The pressurized air exits through aperture 34 parallel to the flow of the batch fluid thereby foaming the same. The fluid then exits body 40 through distal end 31 as foam as generally indicated by arrow 42. As noted above, aperture 33 may be fluidly connected to a separate container of foamable material and enter manifold 23 this way. This is useful when only water is placed within tank 11.

The preferred method of using dispenser 10 comprises filling tank 11 with a batch mixture of soap concentrate and water and pressurizing it to one hundred sixty-five psi. Next hoses 20 and 20' are connected to air tanks 18 and 18' respectively which have been inserted into housings 16 and 17 respectively. Valves 19 and 19' are opened thus introducing pressurized air into manifold 23 in a manner parallel to the flow of fluid through manifold 23, thus foaming the batch mixture therein. Valve 27 is then opened to allow the foamed mixture to pass therethrough to conventional fire hose 44 for application to a fire or the like.

The abovedescribed device provides two primary benefits over the TRIMAX 30 device. First, better foaming action occurs within manifold 23 because the air is injected parallel to the flow of fluid through manifold 23. This precludes a damming effect such as is experienced in the TRIMAX 30 device. Second, hose 38 allows a container of foamable soap concentrate to be attached and introduced to manifold 23 without the need for a batch mixture within tank 11. In field conditions where batch materials may be hard to pressurize within tank 11, this set up may be preferable over the preferred configuration described above.

Figure 4:
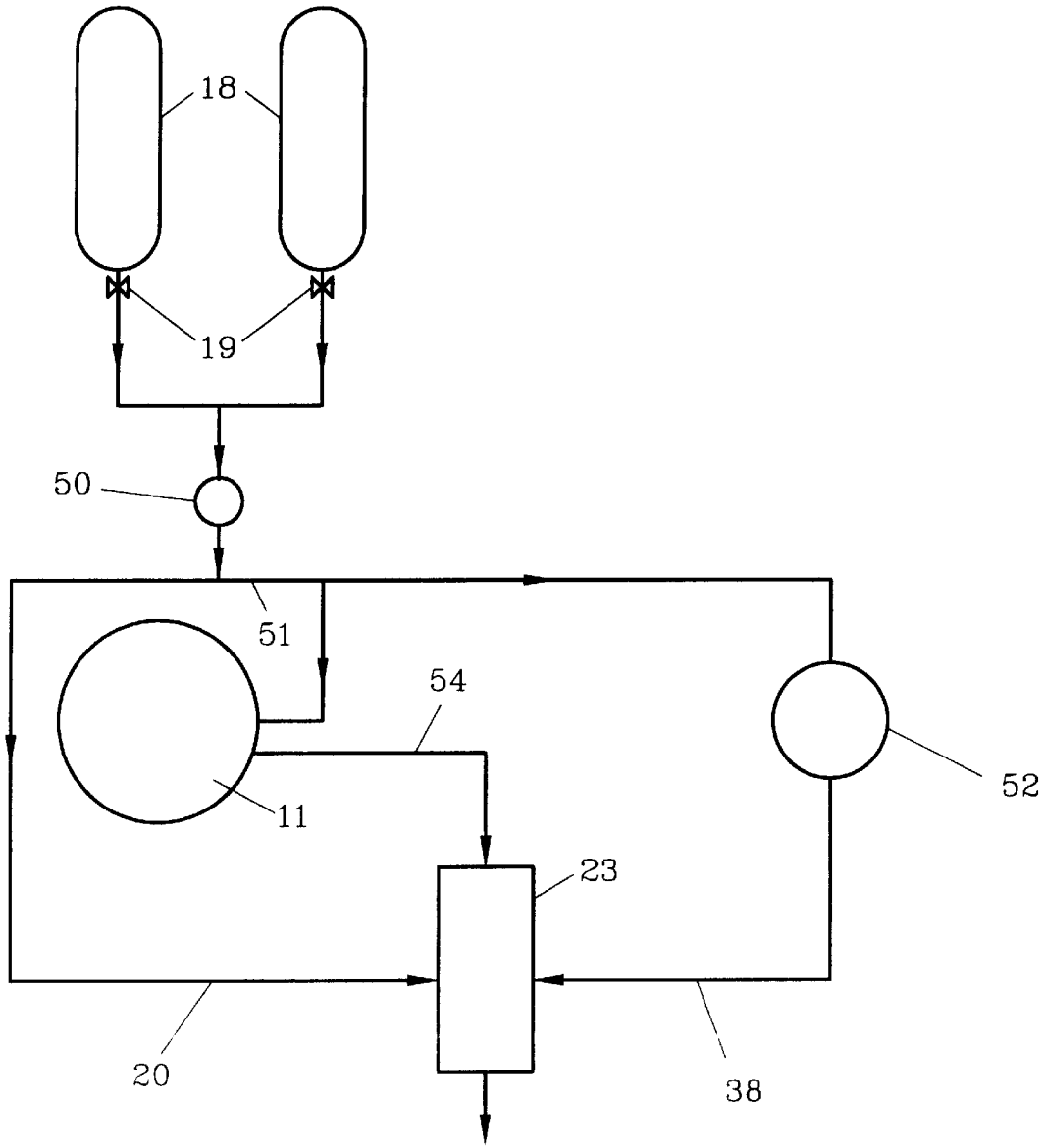
FIG. 4 features a schematic view of an alternate embodiment.

The alternate embodiment is shown schematically in FIG. 4 where tanks 18 are connected by check valve 50 to split air line 51. Air is split to provide pressure to main tank 11 and foaming agent tank 52. Additionally, air is injected into manifold 23 by line 20. Pure water is introduced to manifold 23 by line 54, which corresponds to elbow joint 27, while the foaming agent is introduced into manifold 23 by line 38.

The preceding recitation is provided as an example of the preferred embodiment and is not meant to limit the nature of scope of the present invention or appended claims.

I claim:

1. A foaming water dispenser comprising:

a) a tank, said tank containing a fluid;

b) an air tank, said tank containing a pressurized gas; and c) a manifold, said tank and said air tank fluidly connected to said manifold, said manifold comprising a cross bar, said cross bar defining an aperture, said fluid having a flow through said manifold, said aperture introducing said pressurized gas into said fluid parallel to the flow of said fluid.

2. The foaming water dispenser of claim 1 wherein said fluid is a mixture of foaming agent and water.

3. The foaming water dispenser of claim 1 wherein said pressurized gas is pressurized air.

4. The foaming water dispenser of claim 1 wherein said fluid is pressurized at 65 psi.

5. The foaming water dispenser of claim 1 wherein said pressurized gas is pressurized at 165 psi.

6. The foaming water dispenser of claim 1, further comprising a hose, said hose selectively fluidly connected to said manifold.

7. A foaming water dispenser comprising:

a) a tank;

b) a support frame, said support frame attached to said tank;

c) a plurality of wheels, said plurality of wheels attached to said support frame;

d) a foamable fluid, said fluid contained within said tank;

e) a manifold, said manifold attached to said tank, said manifold comprising a proximal end, a distal end and a cross bar, said cross bar defining an aperture, said tank fluidly connected to said proximal end so that said fluid may flow through said manifold along the longitudinal axis thereof;

f) an air tank, said air tank fluidly connected to said cross bar; and g) pressurized gas, said pressurized gas contained within said air tank, said pressurized gas selectively releasable into said manifold through said cross bar parallel to the flow of said fluid through said manifold.

8. The foaming water dispenser of claim 7 further comprising a handle, said handle attached to said tank.

9. The foaming water dispenser of claim 7 further comprising a fire hose attachment, said fire hose attachment fluidly connected to said manifold.

10. The foaming water dispenser of claim 9 further comprising a valve, said valve selectively allowing said fluid to pass from said manifold to said attachment.

11. The foaming water dispenser of claim 7 further comprising a hose, said hose connecting said air tank to said manifold.

12. The foaming water dispenser of claim 11 further comprising a second hose, said second hose attached to said manifold.

13. A method of dispensing foaming fluid, said method comprising the steps of:

a) providing a pressurized tank filled with a foamable batch mixture;

b) providing a pressurized tank of gas;

c) introducing said gas and said foamable mixture into a manifold parallel to one another thereby precluding a damming effect;

d) foaming the mixture; and e) introducing the foamed mixture into a hose.

* * * * *